US006354377B1

(12) United States Patent
Averhoff

(10) Patent No.: US 6,354,377 B1
(45) **Date of Patent: *Mar. 12, 2002**

(54) GAS DISPLACED CHAMBER LIFT SYSTEM HAVING GAS LIFT ASSIST

(75) Inventor: Jon R. Averhoff, Houston, TX (US)

(73) Assignee: Valence Operating Company, Kingwood, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/405,053

(22) Filed: Sep. 27, 1999

Related U.S. Application Data

(63) Continuation-in-part of application No. 09/339,482, filed on Apr. 24, 1999, now Pat. No. 6,237,692, which is a continuation-in-part of application No. 09/201,017, filed on Nov. 30, 1998, now Pat. No. 6,021,849.

(51) Int. Cl.[7] ..... E21B 43/00
(52) U.S. Cl. ..... 166/372; 166/105
(58) Field of Search ..... 166/372, 105, 166/105.6; 92/37.32; 417/120; 60/370

(56) References Cited

U.S. PATENT DOCUMENTS

| | | | | |
|---|---|---|---|---|
| 3,559,672 A | * | 2/1971 | Chenoweth | 137/155 |
| 3,617,152 A | | 11/1971 | Cummings | |
| 4,589,494 A | | 5/1986 | Sakoda | |
| 4,708,595 A | | 11/1987 | Maloney et al. | |
| 5,141,412 A | | 8/1992 | Meinz | |
| 5,211,242 A | | 5/1993 | Coleman et al. | |
| 5,217,067 A | | 6/1993 | Landry et al. | |
| 5,407,010 A | | 4/1995 | Hershberger | |
| 5,542,472 A | | 8/1996 | Pringle et al. | |
| 5,562,161 A | | 10/1996 | Hisaw et al. | |
| 5,671,813 A | | 9/1997 | Lima | |
| 5,806,598 A | | 9/1998 | Amani | |
| 6,021,849 A | * | 2/2000 | Averhoff | 166/372 |

FOREIGN PATENT DOCUMENTS

| | | |
|---|---|---|
| DE | 23 64 737 | 7/1975 |
| RU | 570697 | 8/1977 |
| RU | 1204-700 A | 5/1986 |

OTHER PUBLICATIONS

The Technology of Artificial Lift Methods. vol. 2a pp. 124–132.

Otis Single and Dual–Acting Gas Pumps: To Enhance Artificial Lift Production for Light and Heavy Crude in Shallow and Deep Wells. Otis Engineering sales brochure.

* cited by examiner

*Primary Examiner*—David Bagnell
*Assistant Examiner*—John Kreck
(74) *Attorney, Agent, or Firm*—Harrison & Egbert

(57) ABSTRACT

An artificial lift system for use in a well bore including at least one chamber having an inlet and an outlet, a power gas string in valved communication with the chamber, a liquid string in valved communication with the outlet of the chamber, a vent in valved communication with the chamber and in valved communication with the liquid string at a location above the chamber, a compressor connected to the power gas string and adapted to pass a pressurized gas into the power gas string, and a valve connected to the power gas string and to the chamber the adapted to selectively allow the pressurized gas to enter the chamber so as to cause a liquid in the chamber to pass through the outlet of the chamber and into the liquid string. The vent has a check valve connected to the liquid string and adapted to pass a portion of the vented gas into the liquid string. The liquid extends continuously as an ungasified liquid along the liquid string from the outlet to the check valve between the vent and the liquid string.

5 Claims, 2 Drawing Sheets

GAS DISPLACED CHAMBER LIFT SYSTEM HAVING GAS LIFT ASSIST

RELATED APPLICATIONS

The present application is a continuation-in-part of U.S. application Ser. No. 09/339,482, filed on Jun. 24, 1999, and entitled "Gas Displaced Chamber Lift System Having a Double Chamber", now U.S. Pat. No. 6,237,692. U.S. patent application Ser. No. 09/339,482 is a continuation-in-part of U.S. application Ser. No. 09/201,017, filed on Nov. 30, 1998, and entitled "Gas Displaced Chamber Lift System", now U.S. Pat. No. 6,021,849.

TECHNICAL FIELD

The present invention relates to artificial lift systems. More particularly, the present invention relates to chamber lift systems which are used so as to deliver oil, water and gas from a wellbore to a surface above the wellbore. More particularly, the present invention relates to gas-displaced chamber lift systems.

BACKGROUND ART

At the present time, it is common to permit oil and gas wells to flow under their own natural pressure as long as they will do so and then to apply a mechanical reciprocating pump to complete the removal of the liquids. This method, although in general use, is cumbersome and unsatisfactory. Because suction will only raise oil for a distance of some thirty-five feet, it is necessary to have the pump near the bottom of the well so that it can exert pressure instead of suction on the liquids coming out of the well. This involves the use of pump rods of lengths of 5,000 feet or greater. In many instances when the pump plunger or the valves become worn, it is necessary to remove the pump from that depth to replace the worn parts. Furthermore, the collars on the pump rod wear rapidly and all the pump parts do likewise because of the small particles of grit that remain in the liquid and the whole device is mechanically inefficient because of the relatively long pump rods that must be reciprocated to perform the pumping operation.

When the natural flow of liquid from a well has ceased or becomes too slow for economical production, artificial production methods are employed. In many cases, it is advantageous, at least during the first part of the artificial production period, to employ gas lift. Numerous types of equipment for producing liquid by gas lift are available, but they all rely upon the same general principles of operation. In the usual case, dry gas consisting essentially of methane and ethane is forced down the annulus between the tubing and the casing and into the liquid in the tubing. As the liquid in the tubing becomes mixed with gas, the density of the liquid decreases, and eventually the weight of the column of the gasified liquid in the tubing becomes less than the pressure exerted on the body of liquid in the well, and the flow of liquid occurs at the surface. While, in some cases, the dry gas may be introduced through the tubing so as to cause production through the annulus, this is not preferred unless special conditions are present.

One known gas lift technique injects gas into the casing, which has been sealed or packed off at the bottom of the hole relative to the production tubing. A gas lift valve is placed in the production tubing at the production level, and the gas lift valve permits the gas to be injected into or bubbled very slowly into the liquid being produced from the well. This gas then makes the liquid in the production tube somewhat lighter and, hence, the natural formation pressure will be sufficient to push the liquid up and out of the well. This means that the well can be produced at a greater rate. This gas lift technique is known as continuous gas lift.

A further adaptation of this gas lift technique is known as intermittent gas lift. In this technique, rather than letting the gas enter the production tube slowly, the gas is injected into the production tubing very quickly, in short bursts, thereby forming a large slug of liquid in the production tubing above the injected gas bubble. The gas bubble then drives the slug of liquid in the production tubing upwardly. The technique is repeated successively, thereby producing successive slugs of liquid at the wellhead.

Another type of gas lift tool involves a procedure where a string of production tubing extending from the surface to the zone of interest is provided with a number of gas lift valves positioned at spaced intervals along the length of the tubing. Gas is injected from the annulus between the tubing and the well pipe through the gas lift valves and into the tubing for the purpose of forcing liquid upwardly to the surface and ultimately into a flowline that is connected with the production tubing. Gas lift systems for liquid production are quite expensive due to the cumulative expense of the number of gas lift valves that are ordinarily necessary for each well. Moreover, each of the gas lift valves must be preset for operation at differing pressures because of the vertical spacing thereof within the tubing string and because the valves must function in an interrelated manner to achieve lifting of liquid within the tubing string.

In the past, various patents have issued relating to such gas lift systems. For example, U.S. Pat. No. 5,671,813, issued on Sep. 30, 1997 to P. C. Lima describes a method and apparatus for the intermittent production of oil. In this method, two production strings extend downwardly from a wellhead of an oil well to a point adjacent a producing region. The lower ends of the two production strings are connected by a coupling which allows a mechanical interface launched adjacent the wellhead of one of the production strings to descend along the production string through the coupling and upwardly through the other production string to displace oil from the production strings to a surge tank. High pressure gas is utilized to move the mechanical interface through the production strings and suitable valves are provided for controlling the flow of gas and oil through the production strings.

U.S. Pat. No. 5,562,161, issued on Oct. 8,1996 to Hisaw et al. describes a method of accelerating production from a well. This method includes the steps of installing a venturi device within the well. A gas is injected within the annulus and introduced into the well. The venturi device creates a zone of low pressure within the well as well as accelerating the velocity of the production fluid so that the inflow from the reservoir is increased.

U.S. Pat. No. 5,407,010, issued on Apr. 18, 1995 to M. D. Herschberger teaches an artificial lift system and method for lifting fluids from an underground formation. This artificial lift system includes a production tubing through which the fluid is carried from the formation to the surface and a pressure reducer, such as a venturi, connected to the production tubing to artificially raise the level of the fluid in the production tubing above the static level associated with the head pressure of the fluid in the formation.

U.S. Pat. No. 5,217,067, issued on Jun. 8, 1993 to Landry et al. describes an apparatus for increasing flow in an oil well which includes an injection valve so as to enable gas to be injected and to cause the oil or other liquid within the well to be lifted to the surface. The valve has a valve body having an inlet at one end and an outlet at the other end which are adapted to be fitted into conventional production oil tubing. A gas injection port opens into the outlet of the valve body and there is at least one gas inlet opening in a side of the valve body. This gas inlet opening is connected to the gas injection port. This enables compressed gas to be sent down the well between the casing and the tubing and injected through the gas injection port and into the flow of oil.

U.S. Pat. No. 5,211,242, issued on May 18, 1993 to Coleman et al. describes a chamber in a well which is connected to two externally separate tubing strings to unload liquid which is applying backpressure against a formation so that the production of fluid from the formation is obstructed. Volumes of the liquid are intermittently collected in the chamber and lifted out of the well through one of the tubing strings in response to high pressure gas injected solely into the chamber through the other tubing string.

U.S. Pat. No. 4,708,595, issued on Nov. 24, 1987 to Maloney et al. describes an intermittent gas-lift apparatus and process of lifting liquids. This apparatus includes a chamber on the downhole end of a production tubing in communication with a sidestring tube. The sidestring tube is in communication with the high pressure gas stored within the casing and above and below a packer. A valve in the sidestring tube permits the entrance of a lifting gas into the chamber to lift the liquids flowing therein to the surface. A surface bleed-down system minimizes the pressure in the production tubing. This increases the pressure differential between the formation and the interior of the casing and lifting chamber during the operation of the apparatus.

German Patent No. 23 64 737, published on Jul. 10, 1975, teaches a compressed air lift pump for deep wells in which the pump has a number of stages one above the other. Liquid is raised by air from the reservoir of one stage to the reservoir of the next. Each stage has two air supply pipes which contain three-way valves operated by an electronic timer to admit and release air alternately.

Soviet Patent No. 1204-700-A teaches an intermittent gas lift system for a pump well which includes a tubing, a packer, a substitution chamber and intake valve, lift starter valves and working valves with a seal and a seat over a space connected to the chamber. The rising level of fluid in the chamber raises the float so as to close off ports and thus raise pressure above the diaphragm so as to clear the valve and transfer gas to the chamber. This gas forces the fluid into the tubing and uses a pressure gradient to hold the ports closed. Gas eventually enters the tubing after all fluid has been expelled, thus opening the two ports by lowering the float back down. Gas is removed entirely from the chamber by the incoming fluid.

Soviet Patent No. 570697 teaches an oil production facility including a displacement chamber, two strings of compressor pipes of which one is coupled to the surface drive. The gas from the chamber is recuperated and expanded. When one vessel is empty, fluid is drawn into the displacement chamber. The second vessel pumps oil over into the empty vessel so as to raise its pressure to the point required to drive the hole fluid over into the lifting string to the surface. Once the fluid in the chamber reaches the bottom of the lift string, the motor reverses so as to turn an electric shaft and compress the gas in the first vessel to repeat the process in a second hole.

U.S. Pat. No. 3,617,152, issued on Nov. 2, 1971 to Leslie L. Cummings, discloses a method and apparatus for the artificial lifting of well fluids. In particular, this device utilizes an automatic well pump which utilizes compressed power gas to displace well production fluids from the well bore to the earth surface. Power gas is exhausted from the pump so as to be collected in a chamber at a desired predetermined superatmospheric pressure to reduce the energy required to compress the air. This device utilizes gas assist lifting so as to move the liquid, in stages, to the surface. Also, the device uses the compressed gas, as opposed to the vented gas, for the gas assist.

A publication of Otis Engineering Corporation, dated 1982, and entitled "Otis Single and Dual-Acting Gas Pumps" describes a gas assist system in which the pump displaces a barrel of oil with a barrel of gas volume at a lift depth pressure. When the gas pressures are too low to lift wells by positive displacement, the gas pump can be aligned with gas lift to lift deeper with lower pressures. The gas lift supply comes from the compressor at various stages along the liquid string.

U.S. Pat. No. 5,806,598, issued on Sep. 15, 1998, to M. Amani describes an apparatus for removing fluids from underground wells. This device includes a supply valve having an open supply position to supply gas to the chamber and a closed supply position. The device further includes a vent valve having an open vent position to vent gas from the chamber and a closed vent position. An actuator communicates with a source of pressurized fluid at the surface for actuating the supply and vent valves. The actuator moves the supply valve to the open position and the vent valve to the closed position, and alternately moves the vent valve to the open position and the supply valve to the closed supply position.

A major problem with the aforedescribed artificial lift systems is that they do not work effectively in deep well and sour gas environments. In particular, at depths of greater than 10,000 feet, the temperature range encountered can be approximately 300 degrees Fahrenheit. As such, any mechanical pumping apparatus will not work effectively at such temperatures. At such great depths, the rod pump devices and submersible pump apparatus do not effectively deliver oil and gas to the surface. For example, at such great depths, the pump rod will have an extreme length which cannot be easily reciprocated back and forth. Furthermore, the cost associated with such a lengthy pump rod would not allow for efficient production. The high temperature and pressures encountered at such depth cause submersible pumps and hydraulic pumps to fail quickly.

In those systems in which the intermittent production of "slugs" of oil is utilized, such systems are ineffective at such depths. In each case in which a "slug" of oil is produced, the gas must be relied upon so as to deliver such a slug to the surface. At great depths, this can take a great deal of time so as to produce an economical amount of oil. Furthermore, the pressure and energy required so as to push such a slug to the surface may exceed the value of the actual production.

Production at such a depth is further complicated by situations in which a corrosive sour gas is encountered. This is particularly true in those cases in which oil and gas must be removed from Smackover wells.

U.S. patent application Ser. No. 09/201,017, filed on Nov. 30, 1998, to the present applicant, describes the original form of the gas displaced chamber lift system. After experimentation, study and analysis, it was found that it was important to have a gas displaced chamber lift system that operated in a relatively continuous mode. In the single chamber gas displaced chamber lift system, liquid would accumulate in the single chamber. After sufficient liquid had accumulated in the chamber, then the valve would open so as to cause the pressurized gas to pass through the power gas string with sufficient pressure so as to evacuate the chamber of the liquid and to pass the liquid from the outlet of the chamber into the liquid string. After the liquid would pass to the liquid string, the pressurized gas from the power gas string would be blocked and the remaining gas within the chamber would be vented to the surface. It was found that during the process of evacuating the chamber and during the process of venting the gas, there was a period of time in which production ceased. It was found to be desirable to allow production (i.e. the accumulation of liquid in the chamber) to continue during the evacuation and venting process. As such, a double chamber approach was devised and disclosed in this prior application. Parent patent application Ser. No. 09/201,017 described a double chamber approach in which one of the chambers was stacked on top of the other chamber or in which one chamber was located interior of and in concentric relationship with the other chamber. After experimentation and analysis, it was found that such an arrangement was difficult to configure within the well bore. Additionally, the stacked arrangements could occasionally produce varying quantities of liquid within the respective chambers due to the head pressure within the well.

U.S. patent application Ser. No. 09/339,482, filed on Jun. 24, 1999, to the present Applicant describes a modified form of the gas displaced chamber lift system. After experiment and analysis, it was found that the efficiency of the subject matter of this patent application could be improved by utilizing the vented gases for the purposes of reducing the weight of the liquid in the liquid string. Since the gas displaced chamber lift system would vent the gases from the chamber, it was felt that the vented gases could be put to better use by simply reinfecting such gases into the liquid string. However, because of the pressures within the liquid string, the gas could not be injected, efficiently, into the liquid string when the pressures within the liquid string are too great. Furthermore, U.S. patent application Ser. No. 09/339,482 describes a valving system placed exterior to the liquid string. As such, in order to accommodate both the shifting valve and the liquid string, the shifting valve required a minimal amount of space. Upon further experimentation and analysis, it was found that a better design could be achieved for the placement of the shifting valve within the well bore.

It is an object of the present invention to provide an artificial lift system which works effectively at depths of greater than 10,000 feet.

It is a further object of the present invention to provide an artificial lift system which can operate in a high temperature environment at the bottom of the well.

It is another object of the present invention to provide an artificial lift system in which production from the liquid string occurs continuously without the need for transporting a "slug" of oil to the surface.

It is another object of the present invention to provide an artificial lift system which works effectively in highly corrosive sour gas environments.

It is another object of the present invention to provide an artificial lift system which can lift liquid volumes of approximately 500 barrels per day.

It is a further object of the present invention to provide an artificial lift system which can operate in a very "gassy"/high API oil gravity environment.

It is still a further object of the present invention to provide an artificial lift system which can handle saturated brines of greater than 200,000 parts per million.

It is still another object of the present invention to provide a double chamber gas displaced chamber lift system in which at least one chamber is continuously available for the accumulation of liquid therein.

It is a further object of the present invention to provide a double chamber gas displaced chamber lift system in which the chambers can be alternately evacuated and vented without interrupting production capacity.

It is still a further object of the present invention to provide a double chamber gas displaced chamber lift system which is easy to configure and easy to install within the well bore and which is not subject to varying head pressures within the well bore.

It is still a further object of the present invention to provide an artificial lift system which can improve efficiency by reinjecting the vented gas into the liquid string.

It is another object of the present invention to provide an artificial lift system which maximizes the space in the well bore available for the installation of the shifting valve.

These and other objects of the present invention will become apparent from a reading of the attached specification and appended claims.

SUMMARY OF THE INVENTION

The present invention is an artificial lift system for use in a well bore that comprises at least one chamber having an inlet and an outlet, a power gas string in valved communication with the chamber, a liquid string in valved communication with the outlet of the chamber, a vent in valved communication with the chamber and in valved communication with the liquid string at a location above the chamber, a compressor connected to the power gas string and adapted to pass a pressurized gas into the power gas string, and a valve connected to the power gas string and to the chamber. The valve is adapted to selectively allow the pressurized gas to enter the chamber so as to cause a liquid in the chamber to pass through the outlet of the chamber and into the liquid string.

In the present invention, the vent has two components. A first venting tube has a check valve connected to the liquid string. The check valve is adapted to pass a portion of the vented gas into the liquid string. Another vent tube extends from the chamber so as to vent a remaining portion of the vented gas into the well bore. The valved communication between the vent and the liquid string is at a location at least 2500 feet above the chamber.

In the present invention, the liquid will extend continuously as an ungassified liquid line along the liquid string from the outlet of the chamber to the area of valved communication between the vent and the liquid string. In the present invention, the compressor is adapted to pass a pressurized gas of greater than 5,000 p.s.i. into the power gas string. In the present invention, the valve is actually positioned in the liquid string. A liquid bypass extends around the valve.

In the preferred embodiment of the present invention, there is a first chamber having an inlet and an outlet, and a second chamber having an inlet and an outlet. The second chamber is arranged in parallel relation to the first chamber. The first chamber is, in particular, arranged in spaced and separate relationship to the second chamber. The first chamber has an approximately equal volume to the second chamber. The first chamber has a top end aligned in a horizontal plane with a top of the second chamber. Also, the first chamber has a bottom end aligned in a horizontal plane with a bottom of the second chamber.

In the present invention, the vent is connected to the liquid string so as to reinject vented gas into the liquid string for the purposes of lightening the weight of the liquid within the liquid string. The vent tube that is connected to the liquid string must have sufficient length so as to allow the pressurized vented gas to actually enter the liquid in the liquid string. After the pressure of the vented gas with the pressure in the liquid line reach equilibrium, then the remainder of the vented pressurized gas will exit the chamber through the second vent tube into the well bore.

DETAILED DESCRIPTION OF THE PRESENT INVENTION

Figure 1:
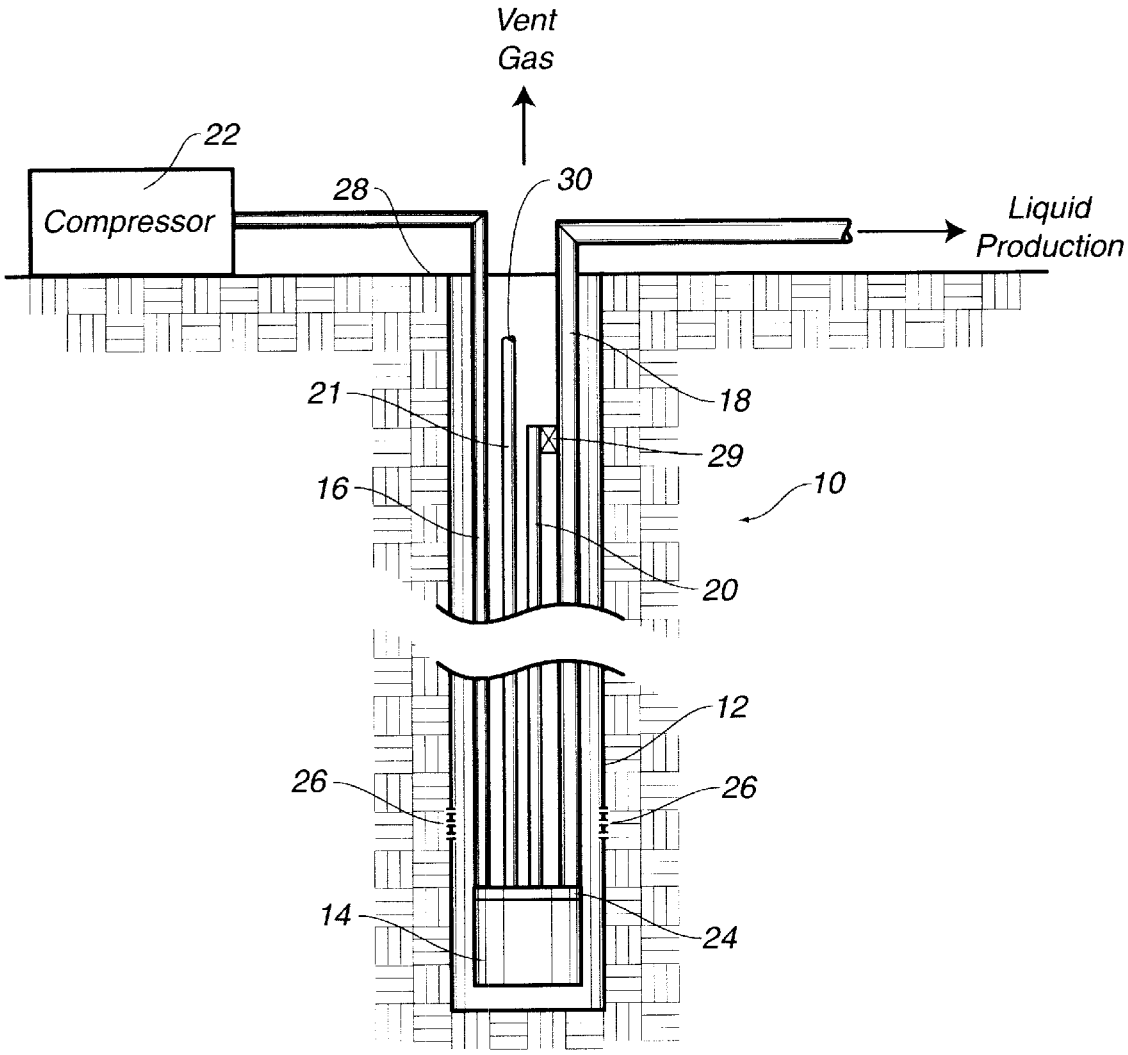
FIG. 1 is a diagrammatic cross-sectional view showing the configuration of the artificial lift system of the present invention.

Referring to FIG. 1, there is shown diagrammatically at 10 the artificial lift system in accordance with the teachings of the present invention. The artificial lift system 10 is used for the extraction of oil, water and gas from the wellbore 12. The artificial lift system 10 includes a chamber 14, a power gas string 16, a liquid string 18, a first vent stack 20 and a second vent stack 21, and a compressor 22. A suitable valving mechanism 24 is provided in association with the chamber 14. The valving mechanism 24 will be described in greater detail in connection with the illustrations of FIGS. 2 and 3.

As can be seen in FIG. 1, the chamber 14 is located in the wellbore 12 below the perforations 26 that are formed in the wellbore 12. The chamber 14 could also be positioned above the perforations 26 in the wellbore 12. The perforations 26 can be associated with perforations that are formed in an existing casing or in an existing production tubing. The power gas string 16 will extend from the compressor 22 to the chamber 14. The valving mechanism 24 is interactively connected with the power gas string 16 so as to allow pressurized gas to enter the chamber and to cause any liquid in the chamber 14 to pass through an outlet in the chamber and into the liquid string 18. Any liquids within the chamber 14 will enter the liquid string 18 in a continuous flow line along the liquid string 18. The liquid within the liquid string 18 will be ungasified from the outlet of the chamber 14 to the connection of the liquid string 18 with the first vent stack 20. The liquid string 18 extends from the chamber 14 to the wellhead area 28. As such, liquid, such as oil, can be removed from the wellbore 12. Vent stack 20 is illustrated as extending from the chamber 14. The vent stack 20 will extend from the chamber 14 and be connected through the use of a check valve 29 to the liquid string 18. The vent stack 20 will be sufficiently long so as to allow the release of pressurized gas into the liquid string 18 at a location where the pressures within the liquid string 18 allow for the introduction of such pressurized gas. The vent stack 21 is also illustrated as extending from the chamber 14. The vent stack 21 should have a suitable height so that the outlet 30 of the vent stack 21 is located in a position above the perforations 26. It should be noted that when the pressurized gas from the chamber 14 is released through the vent stack 20 and through the check valve 29 into the liquid string 18 that, eventually, the pressures will reach equilibrium. As a result, the remaining pressurized gas from the chamber 14 will be released into the well bore 12 through the vent stack 21.

In FIG. 1, the compressor 22 should be a multi-stage compressor which can produce at least 5,000 p.s.i. of gas pressure. This relatively large amount of gas pressure is required so as to push the entire line of liquid from the chamber 14 in a continuous line through the liquid string 18. The valving mechanisms, along with the associated tubing, should have sufficient integrity to withstand such pressure. The power gas string 16 and the liquid string 18 can be formed of coiled tubing. Such coiled tubing can be run in and pulled from the well together as siamese strings. This provides an enormous efficiency in the installation and removal of such power gas and liquid strings.

Figure 2:
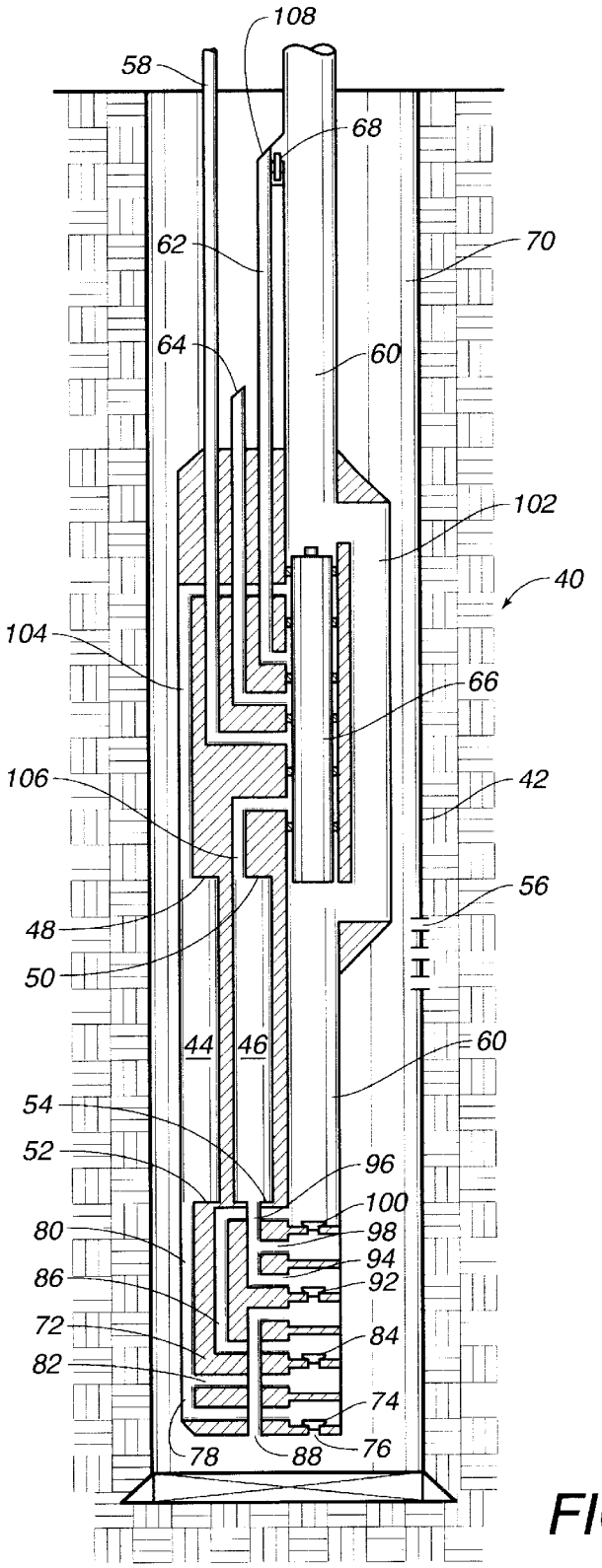
FIG. 2 is a cross-sectional view illustrating the preferred embodiment of the present invention.

FIG. 2 shows the preferred embodiment of the artificial lift system 40 of the present invention. The artificial lift system 40 is located in a well bore 42. In the artificial lift system 40 of the present invention, a first chamber 44 is positioned within the well bore 42 in spaced parallel relationship to a second chamber 46. The chambers 44 and 46, preferably, have equal volumes. So as to avoid problems associated with differing hydrostatic pressures, the top 48 of chamber 44 and the top 50 of chamber 46 will be in the same horizontal plane. Similarly, the bottom 52 of chamber 44 will be in the same horizontal plane as the bottom 54 of chamber 46. It has been found that this side-by-side relationships of the chambers 44 and 46 to be more easily installed within the well bore 42 without undue mechanical manipulation or structural engineering. Furthermore, the positioning of the chambers 44 and 46, at approximately the same location within the well bore, avoids any differences in the loading of chambers 44 and 46 because of the head pressure within the well. The arrangement of the chambers 44 and 46 in the side-by-side spaced relationship facilitates the automatic and continual cycling of the artificial lift system without uneven liquid accumulation within the chambers.

In FIG. 2, it can be seen that the well bore 42 includes perforations 56 that are formed along the wall of the well bore 42. As such, liquid from the subsurface earth formation can enter the well bore 42 and eventually accumulate within the chambers 44 and 46.

In FIG. 2, the power gas string 58 is arranged so as to be in valved communications with each of the chambers 44 and 46. The liquid string 60 also extends so as to be in valved communication with the chambers 44 and 46. A first vent stack 62 was further connected in valved communication with the chambers 44 and 46. Also, a second vent stack 64 is connected in valved communication with the chambers 44 and 46. A shifting valve 66 is provided within the artificial lift system 40 so as to suitably connect each of the above-identified components with the respective chambers 44 and 46. The operation of the shifting valve 66 will be described in greater detail hereinafter.

It can be seen that the first vent stack 62 is connected with a check valve 68 to the liquid string 60. As such, gas will flow from the first vent stack 62, through the check valve 68 and into the liquid string 60. As will be described hereinafter, an emperial analysis of the pressures within the well bore 42 would indicate that the vent stack 62 should have a length of at least 2,500 feet. If the first vent stack 62 is not sufficiently long, then the pressure of the liquid within the liquid string 60 will prevent the introduction of pressurized vent gases into the liquid string 60. As such, the vented gases should be introduced into the liquid string 60 at a location where the pressure of the liquid within the liquid string 60 allows for the introduction of such gases at an economically and energy efficient manner.

The second vent stack 64 has an outlet which is located above the perforations 56 in the casing of the well bore 42. As such, the second vent stack 64 is suitable for venting gas into the annulus 70 of the well bore 42. Alternatively, the vent stack 64 could be connected to the compressor 22 (as shown in FIG. 1) at the surface of the well to improve the efficiency of the compressor. Alternatively, and still further, the vent stack 64 could extend to the surface so that the gases received therefrom could be stored and reused.

With respect to the accumulation of liquids within the chambers 44 and 46, it is to be noted that there is a system of check valves 74, 84, 92 and 100 implemented in the bottom packing 72 of the system 40. Initially, an inlet check valve 74 is positioned adjacent to the passageway 76. Inlet check valve 74 allows any liquids from the annulus 70 of the well bore 42 to pass thereinto and through passageway 78 and 80 and into the chamber 44. Check valve 74 will prevent any liquids from passing out of passageway 76. During the injection of pressurized gas into the chamber 44, any liquids on the interior of the chamber 44 will pass through passageway 80, through passageway 82, through check valve 84, through passageway 86, and into the liquid string 60. Check valve 84 will prevent any liquids within the liquid string 60 from passing back into and through the various passageways into the first chamber 44.

For the loading of the second chamber 46, initially, liquids from the well bore 42 will pass through the opening 88 and into passageway 90. These liquids will flow through passageway 90, through check valve 92 and into passageway 94. These liquids will then flow through passageway 96 and into the second chamber 46. The check valve 92 will prevent the liquids in the chamber 46 from exiting through the various passageways and out of opening 88. Upon the introduction of pressurized gas into the interior of the second chamber 46, the liquid within the second chamber 46 will pass outwardly therefrom through passageway 96, through passageway 98 and through check valve 100 into the liquid string 60. Check valve 100 will prevent the liquids within the liquid string 60 from passing therethrough and back into the chamber 46.

A shifting valve 66 is provided so as to have a suitable action for the purpose of allowing the power gas string 58 to selectively connect with the chambers 44 and 46 and for allowing the chambers 44 and 46 to be connected to the vent stack 62 and 64. Shifting valve 66 can be of a standard form of valve design which is adapted for the downhole pressures. The shifting valve 66 is wireline retrievable. Unique to the present invention, the shifting valve 66 is actually positioned within the liquid string 60. A liquid bypass line 102 extends around the shifting valve 66 so as to allow liquid in the liquid string 60 to flow in a continuous line therearound. Unlike the parent applications to the present invention where the shifting valve was placed in a side pocket mandrel, in the present invention, the shifting valve 66 is placed directly into the liquid string 60. The liquid bypass line 102 extends around the shifting valve 66. This allows the shifting valve 66 to be of a larger shape. For example, using estimated sizes, if the shifting valve 66 is placed within the liquid string 60, then the shifting valve 66 can have a diameter of 2¼ inches. However, if it is used in a side pocket mandrel, the shifting valve 66 can only have a size of 1¼ inches. As a result, the present invention provides greater amount of room for the proper installation and configuration of the shifting valve 66. The liquid bypass line 102 can have any suitable diameters since the liquids will simply flow through the bypass line 102 in a faster manner if the bypass line 102 is of smaller diameter than the remainder of the liquid string 60.

As shown in FIG. 2, the shifting valve 66 can have two positions. When the shifting valve 66 is in the first position, it connects the power gas string 58 with the passageway 104 to the first chamber 44. In this same position, the connection of the first chamber 44 to the vent stacks 62 and 64 is blocked. As such, the chamber 44 will not communicate with the vent stack 62 and 64. When the shifting valve 66 is in this first position, it will connect the vent stack 62 and 64 with passageway 106 so as to allow the second chamber 46 to vent any pressurized gas into the vent stack 62 and 64. Within the present invention, it should be noted that the vent stack 62 and the vent stack 64 can be suitably timed so that the release through the vent stack 64 will only occur after the pressure equilibrium has been achieved between the pressure of the gas and the vent stack 62 and the pressure of the liquid in the liquid string 60. Alternatively, a single vent stack 62 can be used in which the remaining vented gases can exit through opening 108 after the pressure equilibrium has been reached between the pressure of the gas in the vent stack 62 and the liquid string 60. In this first position, the power gas string 58 is blocked from entering passageway 106. As a result, the second chamber 46 will not connect with the power gas string 58. When the shifting valve 66 is in this first position, power gas will displace any liquids in the chamber 44 into the liquid string 60. In particular, the liquids within the chamber 44 will flow outwardly therefrom through passageway 80, through passageway 82, through check valve 84, through passageway 86, and outwardly therefrom into the liquid string 60. Chamber 46 will simultaneously depressurize and allow any gases to flow therefrom into the vent stack 62 and 64. Simultaneously, chamber 46 will begin to be filled with liquid from the annulus 70 of well bore 42. Chamber 46 receives this liquid through inlet opening 88, through passageway 90, through check valve 92, through passageway 94 and through passageway 96.

When the shifting valve 66 switches to a second position, the connections are reversed. In other words, chamber 44 will communicate with the vent stacks 62 and 64 through passageway 104. Chamber 46 will communicate with the power gas string 58 through passageway 106. In this manner, the present invention is able to achieve simultaneous displacement of one chamber while the other chamber is being depressurized and refilled. It is believed that this double chamber configuration can lift twice as much liquid as a single chamber arrangement. Production capacity is not interfered with since at least one of the chambers 44 and 46 will be continuously receiving liquid from the annulus 70 through passageway 76 or opening 88. This arrangement allows for continuously cycling of the various components rather than an on/off arrangement of a single chamber arrangement.

Within the concept of the present invention, it is to be noted that the shifting valve 66 can move to other positions, if so desired. Under certain circumstances, it may be desirable that the pressurized gas accumulate within the pressurized gas string 58 before being introduced into either of the chambers 44 and 46. As such, the shifting valve 66 can move to a third position in which power gas flow is blocked from either of the chambers 44 and 46. In such an arrangement, the chambers 44 and 46 can simultaneously vent through vent stacks 62 and 64 and/or be filling with liquid from the annulus 70. Another position of the shifting valve 66 would have chambers 44 and 46 communicating with each other and not in communication with vent stacks 62 and 64 nor the power gas string 58. This position of the shifting valve 66 would allow the flow from one chamber to the other. This position of the shifting valve 66 might occur at the point in the lift cycle in which one chamber had completed the displacement of liquids into the liquid string 60 (filled with power gas) and the other chamber had been vented and filled with liquids from the annulus 70. The flow of gas from the just displaced chamber would "precharge" the liquid filled chamber with high pressure gas and thus raise the pressure in said liquid filled chamber. This precharge would reduce the volume of power gas that would be required to raise the pressure in the liquid filled chamber to the pressure required to displace liquids from the chamber to the liquid string 60. The precharge stage will reduce the energy requirements of the system and thus make it more efficient. Still further and alternatively, the shifting valve 66 can be configured so that the shifting valve 66 will move to a position such that the high pressure gases from one of the chambers 44 and 46 will initially vent through the vent stack 62 through the check valve 68 and into the liquid string 60. After a predetermined period of time or a predetermined reduction in pressure, the shifting valve 66 can move to another position so that the remaining vented gases from either of the chambers 44 and 46 will be released through the vent stack 64 into the annulus 70.

Figure 3:
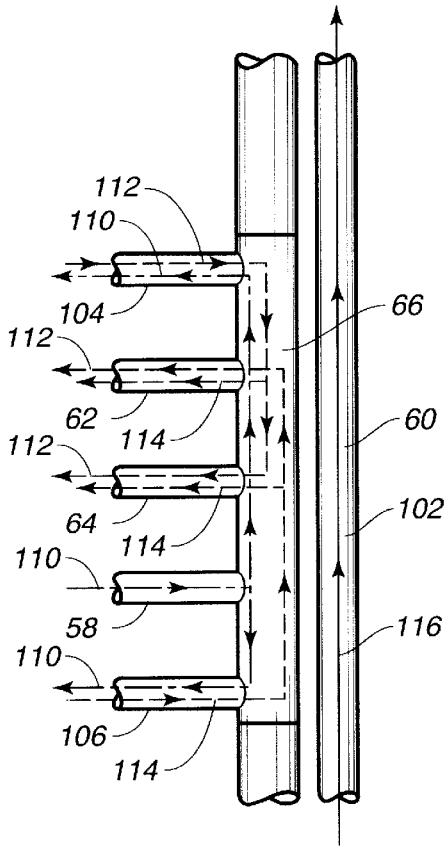
FIG. 3 is a diagrammatic illustration showing the operation of the shifting valve of the present invention.

FIG. 3 illustrates, diagrammatically, how the various fluids flow within the system and through the shifting valve 66. Initially, with respect to the power gas string 58, the power gas is illustrated with broken lines. Depending upon the position of the shifting valve 66, the power gas 110 will pass downwardly through the shifting valve 66 and into the passageway 106 or upwardly into the passageway 104. In the first position of the shifting valve 66, the power gas 110 will flow upwardly into the passageway 104. In the second position, the power gas 110 will flow downwardly into the passageway 106. The vented gases are illustrated by dashed lines. The vented gases 112 from chamber 44 will pass through passageway 104 and downwardly through shifting valve 66 so as to exit the first vent stack 62 or the second vent stack 64. Similarly, the vented gases 114 from the chamber 46 will enter through passageway 106 and will exit through the vented gas stacks 62 and 64. The liquid, which has been evacuated from the chambers 44 and 46 will exit through bypass line 102 of liquid string 60 in the manner illustrated by solid line 116.

An important aspect of the present invention is the economic efficiency achieved by the present invention in the delivery of spent power gas into the liquid string. It is important to note that such economic and energy efficiencies are not achieved throughout the entire length of the liquid string. An analysis of the economic efficiencies of the introduction of gas into the liquid string are shown hereinbelow in Tables I and II.

TABLE I

| | LIQUID STRING BOTTOMHOLE PRESS/PRESS @ GLA INJECTION DEPTH(PSI) | | | | | | | | | | |
|---|---|---|---|---|---|---|---|---|---|---|---|
| INJECT DEPTH(FT) | 0 (0) | 10 (310) | 20 (620) | 30 (928) | 40 (1238) | 50 (1548) | 60 (1858) | 70 (2168) | 80 (2476) | 90 (2786) | 100 (3096) |
| 2500 | 6108 | 5810 | 5702 | 5676 | 5667 | 5669 | 5680 | 5696 | 5722 | 5744 | 5753 |
| | 1188 | 891 | 794 | 761 | 753 | 755 | 765 | 789 | 812 | 832 | 839 |
| 5000 | 6108 | 5841 | 5383 | 5244 | 5191 | 5171 | 5170 | 5191 | 5214 | 5235 | 5256 |
| | 2175 | 1711 | 1434 | 1315 | 1263 | 1243 | 1243 | 1263 | 1285 | 1307 | 1327 |
| 7500 | 6108 | 5597 | 5159 | 4922 | 4798 | 4735 | 4709 | 4714 | 4728 | 4745 | 4769 |
| | 3161 | 2651 | 2215 | 1979 | 1856 | 1793 | 1767 | 1772 | 1786 | 1803 | 1827 |
| 10,000 | 6108 | 5558 | 5054 | 4697 | 4490 | 4371 | 4306 | 4287 | 4284 | 4289 | 4305 |
| | 4145 | 3596 | 3093 | 2738 | 2531 | 2412 | 2348 | 2329 | 2326 | 2331 | 2347 |
| 12,500 | 6108 | 5520 | 4979 | 4544 | 4252 | 4070 | 3961 | 3910 | 3884 | 3872 | 3876 |
| | 5127 | 4540 | 3999 | 3565 | 3247 | 3092 | 2983 | 2932 | 2907 | 2895 | 2898 |

TABLE II

| | | | POWER GAS DATA | | |
|---|---|---|---|---|---|
| | GL ASSIST VOLUME | | GAS | SURFACE | DISP |
| CASE | RATE (MCFD) | CYCLE (SCF) | RATE (MCFD) | PRESS (PSI) | RATIO (SCF/BBL) |
| 20% @ 10,000 FT | 620 | 310 | 2707 | 4618 | 1354 |
| 30% @ 12,500 FT | 926 | 464 | 2477 | 4134 | 1239 |
| 30% @ 10,000 FT | 926 | 464 | 2549 | 4276 | 1273 |

| CHAMBER CONDITIONS PRE/POST GAS LIFT ASSIST | | | GAS LIFT ASSIST FLOW DATA INITIAL/FINAL CONDITIONS | | | | | POWER REQUIREMENTS | | |
|---|---|---|---|---|---|---|---|---|---|---|
| | | GAS VOL | CHAMBER | LIQ STG | DIFFER | FLOW | FLOW | W/O/WITH GAS LIFT ASSIST | | |
| PRESS (PSI) | DENSITY (PPG) | (DIFF) (SCF) | PRESS (PSI) | PRESS (PSI) | PRESS (PSI) | RATE (MCFD) | TIME (SEC) | BHP (BHP) | DELTA (BHP) | % EFFIC (%) |
| 5054/3671 | 1.44/1.11 | 1354/1039 (315) | 5054/3671 | 3093/3093 | 1961/578 | 6732/2714 | 4/10 | 540/444 | 96 | 40/49 |

TABLE II-continued

| | | | | | | | | | | |
|---|---|---|---|---|---|---|---|---|---|---|
| 4544/3565 | 1.32/1.08 | 1236/1011 (225) | NO FLOW-ONLY 225SCF AVAIL-NEED 464SCF @ 12,500' TO ACHIEVE THE FBHP IN LIQ STQ | | | | | | | |
| 4697/2738 | 1.38/.86 | 1273/805 468 | 4697/2738 | 2738/2738 | 1959/0 | 6488/0 | 6/— | 540/403 | 137 | 40/54 |
| | | | WILL NOT WORK-FINAL CHAM PRESS SAME AS PRESS @ INJECT POINT-NO FLOW @ FINAL COND | | | | | | | |

The above tables are gas lift assist calculations based upon the double chamber arrangement (illustrated in FIG. 2) as delivering 2,000 BFPD in which the chambers are located at 15,000 feet of depth. The analysis of Table I is based, in the vertical columns, on the percent of power gas which is utilized and reinjected into the liquid string. The volume of power gas (MCFD) is identified within the parenthesis below the percentage shown in 10% increments.

A brief analysis of the respective pressure analysis which indicate the economic efficiencies are shown in the range in which the spent power gas is reinjected into the liquid string in an amount of 30% at 12,500 feet of depth or in an amount of between 20 and 30% at 10,000 feet of depth. A more detailed analysis of the associated economics are shown in Table II. The ultimately most efficient situation is achieved in which 20% of the spent power gas is injected at 10,000 feet. Horse power requirements of the compressor are reduced from 540 to 444. As such, in such an arrangement, an energy efficiency is achieved. Given the long operating conditions of such a well, such an energy efficiency will translate into significant cost savings. The analysis showed that the economic and energy efficiency was at very marginal levels in which 30% of the spent power gas is injected at either 10,000 feet or 12,500 feet. As such, within the concept of the present invention, it is believed that, in order to achieve certain economic efficiencies where the chamber is positioned at 15,000 feet of depth (for example), the first vent gas stack 62 (as shown in FIG. 2) must extend at least 2,500 feet from the chamber.

The artificial lift system of the present invention is particularly useful for restoring production in depleted high condensate yield sour gas wells. In particular, this system can be applied to Smackover wells. The present invention achieves flowing bottom hole pressures of approximately 600 p.s.i. at 13,000 feet with flowing wellhead pressures of 300 p.s.i. The configuration of the present invention employs an apparatus that can withstand bottomhole temperatures of greater than 300 degrees F. The present system can handle produced gas volumes of 3,000 MCFD. The present invention can achieve the production of liquid volumes exceeding 500 barrels per day. The present invention is suitable for operating in a very "gassy" high API oil gravity environment. Since the wells in which the present invention are intended to be used for producing in sour gas environments, the present invention minimizes the downhole parts. As a result, the present invention avoids the destructive effects of the corrosive environment into which it is placed. The downhole moving parts are wireline retrievable. The present invention can work with saturated brines having greater than 200,000 parts per million chlorides. The present invention is compatible with conventionally-sized production casing. Despite the fact the present invention can be used at very deep depths, the present invention is cost competitive with other forms of lift. It is possible that the present invention can be utilized in depths of up to 25,000 feet and can lift higher volumes of up to 2,000 barrels per day. Unlike intermittent systems, the present invention pushes an entire line of liquid through the liquid string. As such, the transit time of individual "slugs" of liquid is avoided. The liquid string continuously allows the outflow of liquid therefrom. The ability to control and utilize high gas pressures allows for the necessary "brute" force so as to deliver the continuous string of liquid from the liquid string.

The foregoing disclosure and description of the invention is illustrative and explanatory thereof. Various changes in the details of the illustrated construction or in the steps of the described method can be made within the scope of the appended claims without departing from the true spirit of the invention. The present invention should only be limited by the following claims and their legal equivalents.

I claim:

1. An artificial lift system for use in a well bore comprising:

a first chamber having an inlet and an outlet;

a second chamber having an inlet and an outlet, said first chamber arranged in parallel spaced relationship to said second chamber, said first chamber having a volume approximately equal to a volume of said second chamber, said first chamber having a top end aligned in a horizontal plane with a top of said second chamber, said first chamber having a bottom end aligned in a horizontal plane with a bottom of said second chamber;

a power gas string in valved communication with said first chamber and said second chamber;

a liquid string in valved communication with said outlet of said first chamber and with said outlet of said second chamber;

a vent in valved communication with said first chamber and with said second chamber, said vent being in valved communication with said liquid string at a location above said first and second chambers, said vent adapted to pass a vented gas from said first and second chambers and into said liquid string;

a compressor connected to said power gas string and adapted to pass a pressurized gas into said power gas string; and a valve connected to said power gas string and to said first and second chambers, said valve adapted to selectively allow the pressurized gas to enter said first chamber and said second chamber so as to cause a liquid in said first chamber to pass through said outlet of said first chamber and into said liquid string and to cause a liquid in said second chamber to pass through said outlet of said second chamber and into said liquid string.

2. The system of claim 1, said vent having a check valve connected to said liquid string, said check valve adapted to pass a portion of the vented gas into said liquid string, said vent adapted to pass a remaining portion of the vented gas into the well bore.

3. The system of claim 1, said valved communication between said vent and said liquid string being at a location at least 2500 feet above said chamber.

4. The system of claim 1, said compressor adapted to pass a pressurized gas of greater than 5,000 p.s.i. into said power gas string.

5. The system of claim 1, said liquid string having a liquid bypass extending around said valve.

* * * * *